US009593829B2

(12) United States Patent
Dupre et al.

(10) Patent No.: US 9,593,829 B2
(45) Date of Patent: Mar. 14, 2017

(54) HINGE-MOUNTED ROTATING BASE SPOTLIGHT

(71) Applicant: Lucifer Lighting Company, San Antonio, TX (US)

(72) Inventors: Scott Dupre, Riverside, RI (US); Ben Mathews, San Antonio, TX (US)

(73) Assignee: LUCIFER LIGHTING COMPANY, San Antonio, TX (US)

( * ) Notice: Subject to any disclaimer, the term of this patent is extended or adjusted under 35 U.S.C. 154(b) by 171 days.

(21) Appl. No.: 14/258,688

(22) Filed: Apr. 22, 2014

(65) Prior Publication Data

US 2014/0313727 A1 Oct. 23, 2014

Related U.S. Application Data

(60) Provisional application No. 61/814,696, filed on Apr. 22, 2013.

(51) Int. Cl.
*F21V 21/26* (2006.01)
*F21V 19/02* (2006.01)
(Continued)

(52) U.S. Cl.
CPC ..... *F21V 19/02* (2013.01); *F21S 8/036* (2013.01); *F21V 21/30* (2013.01); *F21V 29/773* (2015.01);
(Continued)

(58) Field of Classification Search
CPC ..... F21V 21/15; F21V 21/26–21/30; F21W 2131/406
(Continued)

(56) References Cited

U.S. PATENT DOCUMENTS

D234,710 S 4/1975 Beeren
D253,853 S 1/1980 Gerber
(Continued)

FOREIGN PATENT DOCUMENTS

DE 202009000699 3/2009
DE 102008055864 5/2010
(Continued)

OTHER PUBLICATIONS

Search Report and Written Opinion issued in International Application No. PCT/US2014/034968.
(Continued)

*Primary Examiner* — Sean Gramling
(74) *Attorney, Agent, or Firm* — Norton Rose Fulbright US LLP

(57) ABSTRACT

This disclosure includes adjustable light fixtures and methods for using the same. Some light fixtures use or include a base having a stationary portion with first and second ends, where the first end defines an opening and the second end is configured to secure the fixture to a structure, and a rotatable portion having a mounting surface, where the rotatable portion is configured to be disposed within the opening and to rotate relative to the stationary portion in the plane of the first end, an emitter housing having a first end and a second end, where the first end defines an aperture and the emitter housing defines an interior volume configured to receive a light source, and a hinge coupled to the mounting surface and the second end of the emitter housing, where the hinge is configured to permit angular displacement of the emitter housing relative to the rotatable portion.

20 Claims, 5 Drawing Sheets

(51) Int. Cl.

| | |
|---|---|
| ***F21V 21/30*** | (2006.01) |
| ***F21S 8/00*** | (2006.01) |
| ***F21V 29/77*** | (2015.01) |
| *F21W 131/406* | (2006.01) |
| *F21V 7/00* | (2006.01) |
| *F21V 17/12* | (2006.01) |
| *F21Y 101/00* | (2016.01) |

(52) U.S. Cl.
CPC *F21K 9/20* (2016.08); *F21V 7/00* (2013.01); *F21V 17/12* (2013.01); *F21W 2131/406* (2013.01); *F21Y 2101/00* (2013.01)

(58) Field of Classification Search
USPC ..... 362/269, 275, 285, 287, 372, 419, 362/427–428
See application file for complete search history.

(56) References Cited

U.S. PATENT DOCUMENTS

| | | | | |
|---|---|---|---|---|
| 5,289,358 | A | 2/1994 | Halemeier | |
| 6,079,992 | A | 6/2000 | Kuchar et al. | |
| D592,791 | S | 5/2009 | Sabernig | |
| 7,762,688 | B2 | 7/2010 | Dixon et al. | 362/287 |
| D646,821 | S | 10/2011 | Wauters | |
| D655,841 | S | 3/2012 | Coleman | |
| D664,279 | S | 7/2012 | Meise et al. | |
| D697,245 | S | 1/2014 | Thomas et al. | |
| D703,359 | S | 4/2014 | Thomas et al. | |
| 2006/0146536 | A1* | 7/2006 | Laenen | B64F 1/20 362/269 |
| 2009/0296412 | A1* | 12/2009 | Ogawa | F21S 8/043 362/373 |
| 2011/0164422 | A1 | 7/2011 | Chan | 362/284 |
| 2012/0287625 | A1 | 11/2012 | Macwan et al. | 362/235 |
| 2013/0163243 | A1 | 6/2013 | Reed | 362/235 |
| 2013/0170232 | A1 | 7/2013 | Park et al. | 362/364 |
| 2014/0254176 | A1 | 9/2014 | Schmitt et al. | 362/362 |

FOREIGN PATENT DOCUMENTS

| | | |
|---|---|---|
| EP | 1293724 | 9/2003 |
| EP | 1 657 486 | 5/2006 |
| GB | 870482 | 6/1961 |
| JP | 2003297136 | 10/2003 |
| JP | 1232045 | 3/2005 |
| JP | 2008-047448 | 2/2008 |
| JP | 2008-218188 | 9/2008 |
| TW | 286228 | 9/1996 |
| TW | 287875 | 10/1996 |
| TW | 144227 | 12/2011 |
| WO | WO 2012/111983 | 8/2012 |

OTHER PUBLICATIONS

Installation instruction for You-Turn on H111-35. http://deltalight.com/downloads/manual/6_313_02_1935_HAND.pdf.
Cooper Lighting by Eaton, products C17032, C17042. http://www.cooperindustries.com/content/public/en/lighting/products/indoor_ceiling_wall_mount_lighting/ceiling_mount/_165822.html.
Kurt Versen, products L137, L135, L133. http://www.kurtversen.com/products/1137_1135_1133/.
Taiwanese Office Action and Search Report dated Feb. 6, 2015 for corresponding application No. 103302951 filed May 16, 2014.
Bulb.com, "One Light Adjustable Wall or Ceiling Heat Lamp Fixture with Black Baffle, White Finish", accessed Apr. 8, 2014, 1 page, http://www.bulbs.com/espec.aspx?ID=17518.
Archi Expo, "LED track-light (adjustable)—Star : 55 QPAR 51 DLR—BRUCK", accessed Apr. 8, 2014, 35 pages, htt;://www.archiexpo.com/prod/bruck/led-track-lights-adjustables-53105-1124273.html.
Deltalight®, "Installation Instructions for You-Turn on H111-35", 3 pages, Jan. 10, 2013, www.deltalight.com.
Kurt Versen, "Narrow, Medium, Wide Distribution Surface Form, 5" Diameter", 2014, www.kurtversen.com/products/1137_1135_1133/.
Cooper Industries, "Cooper Lighting by Eaton", 12 pages, 2013, http://www.cooperindustries.com/content/public/en/lighting/products/indoor_ceiling_wall_mount_lighting/ceiling_mount/_165822.html.
International Search Report and Written Opinion issued in PCT/US2015/066083, dated Mar. 31, 2016.

* cited by examiner

HINGE-MOUNTED ROTATING BASE SPOTLIGHT

CROSS-REFERENCE TO RELATED APPLICATIONS

This application claims priority to U.S. Provisional Application No. 61/814,696 filed on Apr. 22, 2013, the contents of which are incorporated by reference in their entirety.

BACKGROUND

1. Field of the Invention

The invention relates generally to light fixtures, and more particularly, but not by way of limitation, to adjustable light fixtures.

2. Description of Related Art

Adjustable light fixtures, such as spotlights, are generally capable of providing illumination that may be adjusted (e.g., by a user) to control, for example, the direction of light output from the fixture. Current adjustable light fixtures employ various adjustment mechanisms. Typically, such mechanisms are configured to readily provide for various adjustments (e.g., rotation, translation, articulation, and/or the like); however, these mechanisms may not be capable of adequately maintaining or holding a selected orientation (e.g., and may be susceptible to inadvertently falling out of adjustment) without requiring cumbersome and/or obtrusive hardware, and/or substantial design compromises.

SUMMARY

Some embodiments of the present fixtures may be configured, through an emitter housing hingedly coupled to a rotatable mounting surface of a base, to provide for simple light fixture adjustment (e.g., angular articulation and rotation), unobtrusive light fixture design, and simple position holding (e.g., once the fixture is adjusted). Some embodiments may be configured to accomplish such desirable functionality using small and/or minimal hardware.

Some embodiments of the present fixtures comprise a base comprising a stationary portion having first and second ends, the first end defining an opening and the second end configured to secure the light fixture to a structure, and a rotatable portion having a mounting surface, the rotatable portion configured to be disposed within the opening and to rotate relative to the stationary portion in the plane of the first end, an emitter housing having a first end and a second end, the first end defining an aperture and the emitter housing defining an interior volume configured to receive a light source, and a hinge coupled to the mounting surface and the second end of the emitter housing and configured to permit angular displacement of the emitter housing relative to the rotatable portion. In some embodiments, the base has a first transverse dimension, the emitter housing has a second transverse dimension, and the first transverse dimension is substantially equal to the second transverse dimension. In some embodiments, the base and the emitter housing are substantially cylindrical.

In some embodiments, the emitter housing further comprises a reflector disposed proximate the first end. In some embodiments, the emitter housing further comprises a lens disposed proximate the first end. Some embodiments further comprise a removable reflector housing configured to be coupled to the first end of the emitter housing, the removable reflector housing having a reflector. In some embodiments, the removable reflector housing comprises a lens configured to convey light from the reflector.

In some embodiments, the emitter housing further comprises a plurality of cooling fins disposed on an interior surface of an outer wall of the emitter housing and extending a distance from the second end towards the first end along a longitudinal axis of the emitter housing. In some embodiments, the emitter housing further comprises an interior wall coupled to each of the plurality of cooling fins such that the outer wall, the cooling fins, and the interior wall cooperate to define a plurality of air cooling channels. In some embodiments, the interior wall further defines an interior channel configured to receive light control components. In some embodiments, the air cooling channels extend through the second end of the emitter housing.

In some embodiments, the hinge is coupled to the mounting surface such that no portion of the hinge extends beyond the stationary portion in a lateral direction when the hinge is in either an open position or a closed position.

In some embodiments, the base is configured to releasably hold a selected planar rotation of the rotatable portion relative to the stationary portion through friction. In some embodiments, the hinge is configured to releasably hold a selected angular displacement of the emitter housing relative to the rotatable portion through friction. In some embodiments, planar rotation of the rotatable portion relative to the stationary portion is limited to a maximum rotation of approximately 362 degrees. In some embodiments, angular displacement of the emitter housing relative to the rotatable portion is limited to a maximum angular displacement of approximately 45 degrees.

In some embodiments, the light source is a light-emitting diode (LED) light source. In some embodiments, the base is configured to receive an LED driver.

Some embodiments of the present methods for adjusting the direction of light from a light fixture having an emitter housing coupled through a hinge to a rotatable portion of a base comprise rotating the rotatable portion, the rotatable portion bounded by a stationary portion of the base, and angularly displacing the emitter housing relative to the rotatable portion through actuation of the hinge.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, 10, and 20 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DESCRIPTION OF ILLUSTRATIVE EMBODIMENTS

Figure 1A:
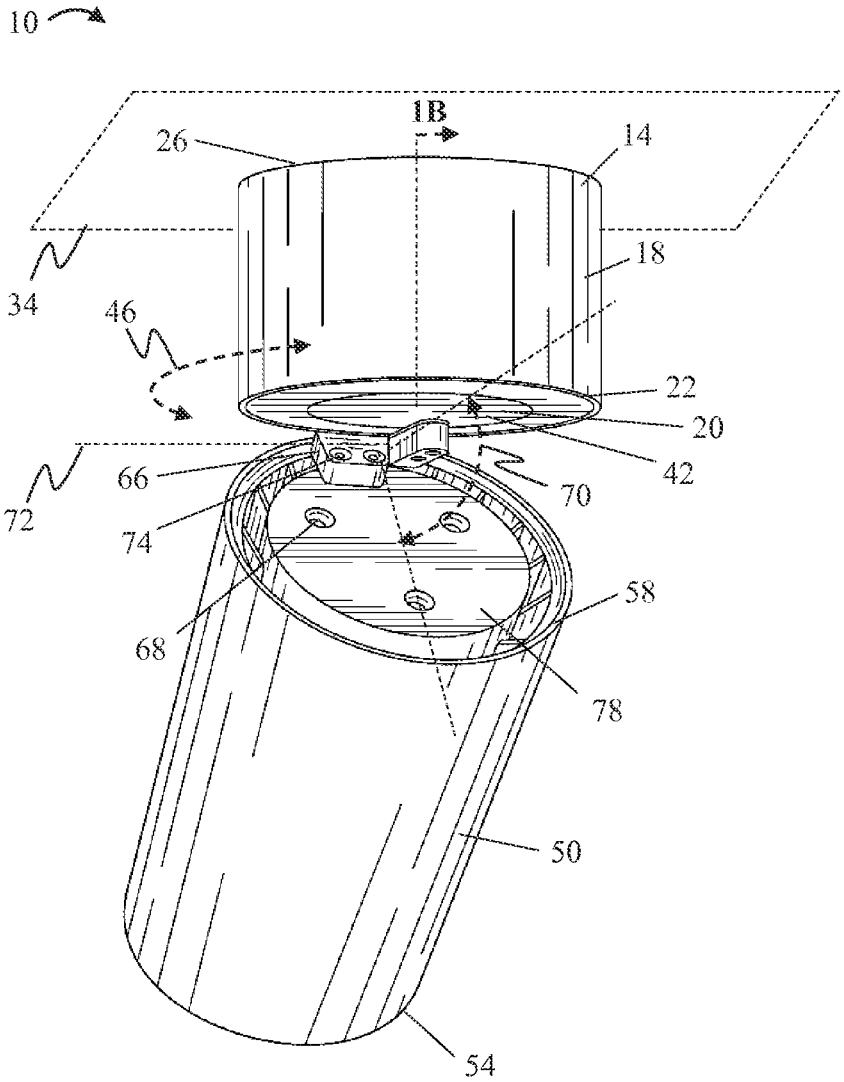
FIG. 1A is a perspective view of a first embodiment of the present light fixtures showing an emitter housing angularly displaced relative to a base.
Figure 1B:
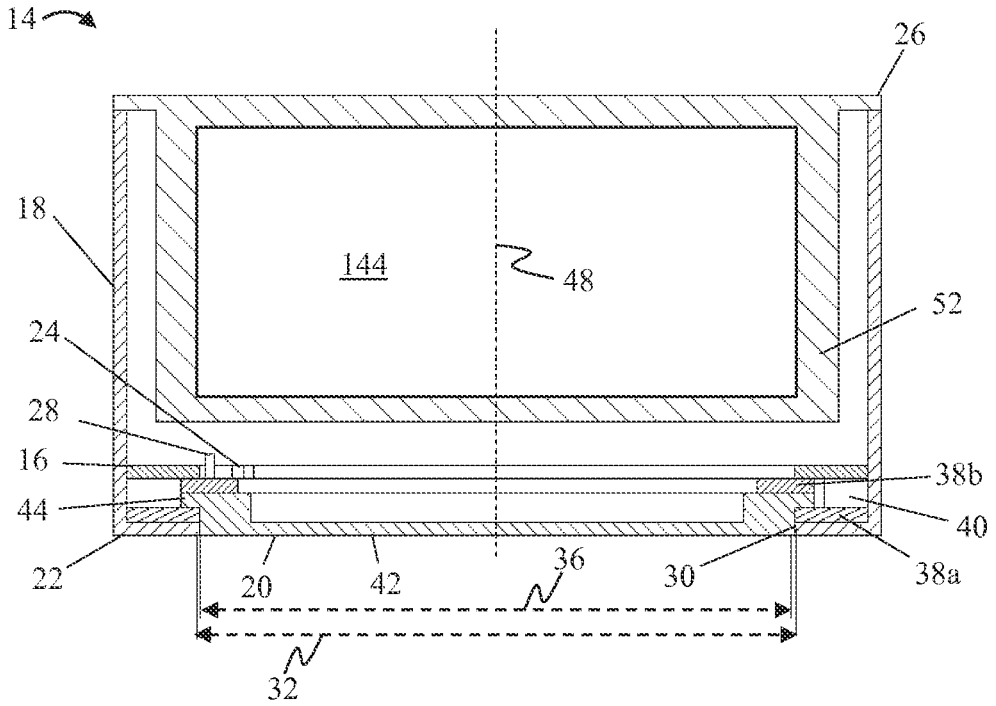
FIG. 1B is a cross-sectional side view of the base of the first embodiment.
Figure 1C:
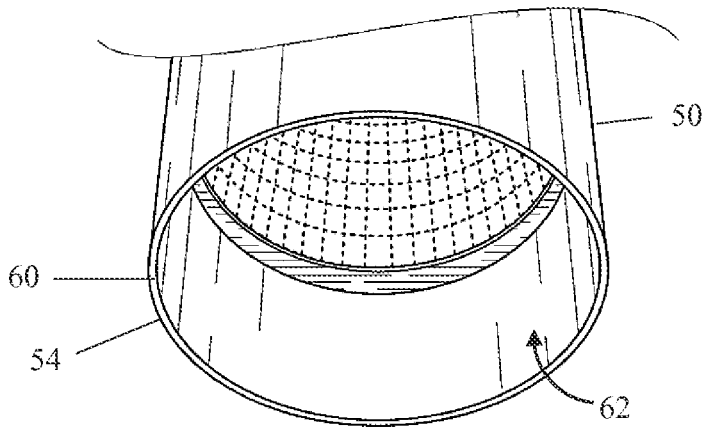
FIG. 1C is a partial perspective view of the emitter housing of the first embodiment.

Referring now to the drawings, and more particularly to FIGS. 1A-1C, shown therein and designated by the reference numeral 10 is a first embodiment of the present light fixtures. Fixture 10 comprises a base 14 with a stationary portion 18 and a rotatable portion 20. Stationary portion 18 is referred to as "stationary" because it is designed to be fixed to a structure; however, stationary portion 18 may be movably coupled to a structure. Similarly, rotatable portion 20 is referred to as "rotatable" because it is designed to rotate relative to stationary portion 18 but need not be rotated relative to stationary portion 18. In the embodiment shown, stationary portion 18 has a first end 22 and a second end 26 configured to secure (e.g., affix) fixture 10 to a structure (e.g., generally indicated as 34), such as, for example, via fasteners (e.g., screws, rivets, and/or the like), interlocking features disposed on second end 26 and/or structure 34, adhesive, and/or the like. Structure 34 can comprise any suitable structure, including, but not limited to, a ceiling, wall, floor, light track, junction box, and/or the like. In the embodiment shown, first end 22 defines an opening 30 that is configured to receive rotatable portion 20 (e.g., such that at least a portion of rotatable portion 20 is surrounded by stationary portion 18, as shown). In the embodiment shown, rotatable portion 20 has a mounting surface 42. In this embodiment, rotatable portion 20 is configured to be disposed within opening 30 such that mounting surface 42 is substantially flush with first end 22 (e.g., portion of first end 22 surrounding opening 30). For example, in the embodiment shown, rotatable portion 20 defines a ridge or shelf 44 that extends laterally beyond mounting surface 42 and past the ends of opening 30 to secure the rotatable portion within the stationary portion (e.g., to prevent inadvertent separation of the rotatable portion from the stationary portion). As shown, in this embodiment, first end 22 and mounting surface 42 are each substantially planar and are substantially co-planar with each other.

In the embodiment shown, rotatable portion 20 is configured to rotate relative to stationary portion 18 in the plane of first end 22 (e.g., rotation generally indicated by arrow 46). While not required in all embodiments, opening 30 and/or rotatable portion 20 can be configured such that the rotatable portion is substantially limited to rotation 46 in the plane of first end 22 (e.g., such that rotatable portion 20 can only rotate about a longitudinal axis 48 of base 14). In this embodiment, for example, opening 30 has a transverse dimension (diameter 32) that is slightly larger than a transverse dimension (diameter 36) of rotatable portion 20 proximate mounting surface 42, as shown (e.g., to limit lateral displacement of rotatable portion 20 relative to stationary portion 18).

In the embodiment shown, rotation (e.g., as indicated by arrow 46) of rotatable portion 20 relative to stationary portion 18 is limited (e.g., to a maximum rotation of approximately 362 degrees (362°), as in the depicted embodiment), such as, for example, via internal stops (e.g., projections) from rotatable portion 20 and/or stationary portion 18, wire(s) extending between rotatable portion 20 and stationary portion 18, and/or any other structure that limits the rotation of rotatable portion 20 relative to stationary portion 18. For example, in the depicted embodiment, base 14 includes a substantially annular clamping ring 16 (e.g., fixed relative to stationary portion 18) having a projection or tooth 24 extending inwardly into the area bounded by the clamping ring. In this embodiment, base 14 also includes a protrusion or stop 28 that extends longitudinally from the rotatable portion towards second end 26 (e.g., and configured to rotate with rotatable portion 20). In this way, rotatable portion 20 and protrusion or stop 28 can rotate within stationary portion 18 until the protrusion or stop contacts projection or tooth 24 of clamping ring 16, thus physically limiting the maximum rotation of rotatable portion 20 relative to stationary portion 18. In other embodiments, the present fixtures can be configured (e.g., through dimensions of protrusion or stop 28 and/or projection or tooth 24) to allow any (limited or otherwise) magnitude of rotation of rotatable portion 20 relative to stationary portion 18 (e.g., limited to 10, 15, 20, 30, 45, 60, 90, 180, 360 degrees or larger, or unlimited, for example, through the use of slip rings to permit any necessary electrical communication between the stationary and rotatable portions regardless of the relative angle of rotation between the portions).

In the embodiment shown, base 14 is configured to resist rotation (e.g., 46) of rotatable portion 20 relative to stationary portion 18 (e.g., via friction applied between the rotatable portion and the stationary portion resulting in a frictional force that is large enough to prevent inadvertent rotation but small enough that the frictional force can be overcome to allow for fixture adjustment, for example, by a user grasping emitter housing 50). For example, in the embodiment shown, base 14 includes friction or sliding surfaces 38*a* and 38*b*, which in the depicted embodiment comprise Teflon (e.g., to facilitate smooth rotatable operation). However, in other embodiments, the friction surfaces can comprise any suitable material (e.g., metals, such as copper, brass, aluminum, steel, and/or the like, plastics, composites, and/or the like, which may be smooth and/or textured). In the embodiment shown, friction surface 38*b* comprises a substantially annular washer that is fixed relative to rotatable portion 20, and friction surface 38*a* comprises a plurality of spacers that are fixed relative to stationary portion 18 (e.g., disposed around the interior of first end 22 of stationary portion 18, as shown). However, in other embodiments, friction surfaces (e.g., 38*a* and/or 38*b*) can comprise any suitable structure, such as, for example, a coating disposed on rotatable portion 20, stationary portion 18 and/or clamping ring 16.

In this embodiment, ridge or shelf 44 is configured to be disposed between friction surfaces 38*a* and 38*b*, as shown, and in this way, friction surfaces 38*a* and 38*b* can substantially define the interface between the rotatable portion and the stationary portion. In the embodiment shown, clamping ring 16 is configured to retain rotatable portion 20 between friction surfaces 38*a* and 38*b*, and is secured in fixed relation to stationary portion 20 (e.g., through fasteners disposed through clamping ring 16 and into mounts 40). Through selection of friction surfaces (e.g., 38 and/or 38*b*), the surface finish of rotatable portion 20 and/or clamping ring 16, and/or the clamping force applied by clamping ring 16, the characteristics (e.g., feel, resistive force, and/or the like) of rotation of rotatable portion 20 within stationary portion 18 can be varied. For example, in this embodiment, fasteners securing clamping ring 16 can be tightened or loosened to adjust the normal force applied to the interface of friction surfaces 38*a* and 38*b* and rotatable portion 20 (e.g., to vary the magnitude of force required to rotate rotatable portion 20 relative to stationary portion 18).

In the embodiment shown, base 14 further comprises an electronics housing 52 (e.g., disposed in and/or defining second end 26) which can be fixed relative to stationary portion 14. In the embodiment shown, electronics housing 52 defines an interior volume 144, which can be configured to receive light control components, described in more detail below (e.g., and can be filled with an insulative material, for example, to insulate electronic components from interference, vibration, and/or the like).

In the embodiment shown, fixture 10 further comprises an emitter housing 50 having a first end 54 and a second end 58. In this embodiment, first end 54 defines an aperture or opening 60. Emitter housing 50 (and/or base 14 described above and/or removable reflector housing 102, describe below) can comprise any suitable material, including, but not limited to, metals, such as aluminum, copper, alloys, and/or the like, composites, such as plastics or carbon fiber and/or the like, and/or the like. In the embodiment shown, emitter housing 50 defines an interior volume 62 configured to receive a light source 64 (described in more detail below). Light source 64 can comprise any suitable light source, such as, for example, one or more electroluminescent lamps (e.g., light-emitted diode(s) or LEDs, incandescent lamps (e.g., halogen bulb(s)), gas discharge lamps (e.g., xenon lamps, fluorescent lamp(s), high-intensity discharge lamps, lasers), and/or the like.

In the embodiment shown, fixture 10 further comprises a hinge 66 coupled to mounting surface 42 and to second end 58 of emitter housing 50 (e.g., as shown), such as, for example, via fasteners (e.g., disposed through holes 74 of the hinge, adhesive, interlocking features, and/or the like). In other embodiments, hinge 66 may be unitary with one or both of the emitter housing and the rotatable portion. Hinge 66 can comprise any suitable structure which permits the functionality described in this disclosure, for example, a friction hinge, barrel hinge, and/or a constant torque type positioning hinge. Hinge 66 can be configured to provide consistent torque, smooth feel (e.g., during adjustment), resist wear, and/or minimally spring-back in response to position adjustments.

In the embodiment shown, hinge 66 is configured to permit angular displacement of emitter housing 50 relative to rotatable portion 20 (e.g., as indicated by arrow 70). In the embodiment shown, hinge 66 is configured to resist angular displacement (e.g., 70) of emitter housing 50 relative to rotatable portion 20 (e.g., via frictional forces, similarly to as described above for rotatable portion 20 within stationary portion 18 of base 14). In the embodiment shown, hinge 66 is configured such that angular displacement (e.g., 70) of emitter housing 50 relative to rotatable portion 20 of base 14 is permitted only about a single axis 72 (e.g., hinge 66 can be a single axis hinge, as shown). In this embodiment, angular displacement (e.g., 70) of emitter housing 50 relative to rotatable portion 20 is limited to a maximum angular displacement of approximately 45 degrees (e.g., due to the configuration of the hinge). In other embodiments, angular displacements can be limited to smaller or larger maximum angular displacements, for example, 5, 10, 15, 20, 30, 45, 60, 90 degrees, or larger.

Figure 2A:
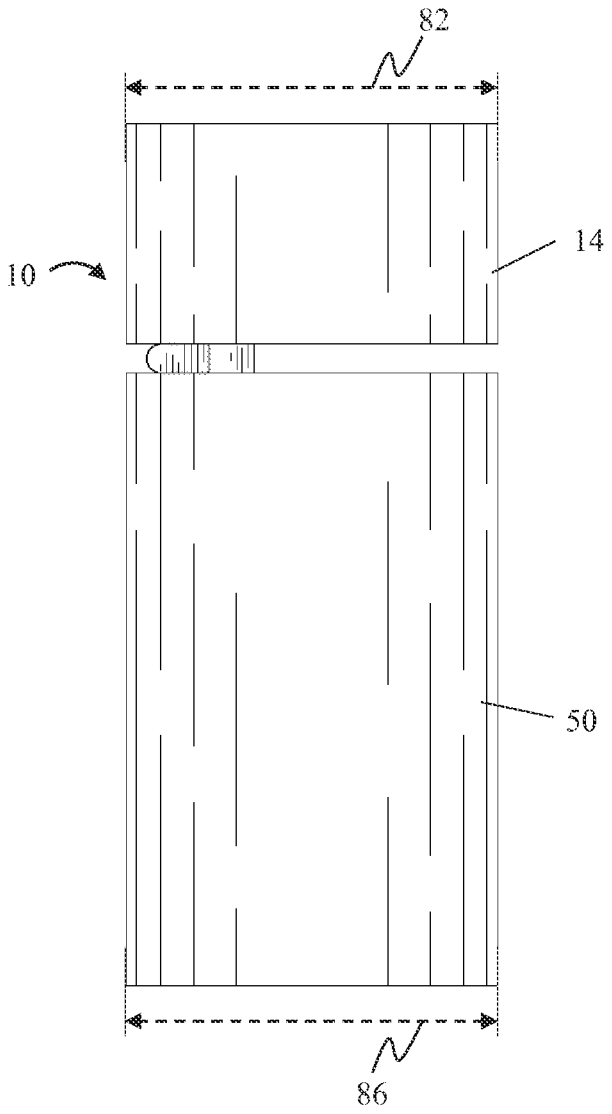
FIG. 2A is a side view of the first embodiment showing the emitter housing aligned with the base.
Figure 3:
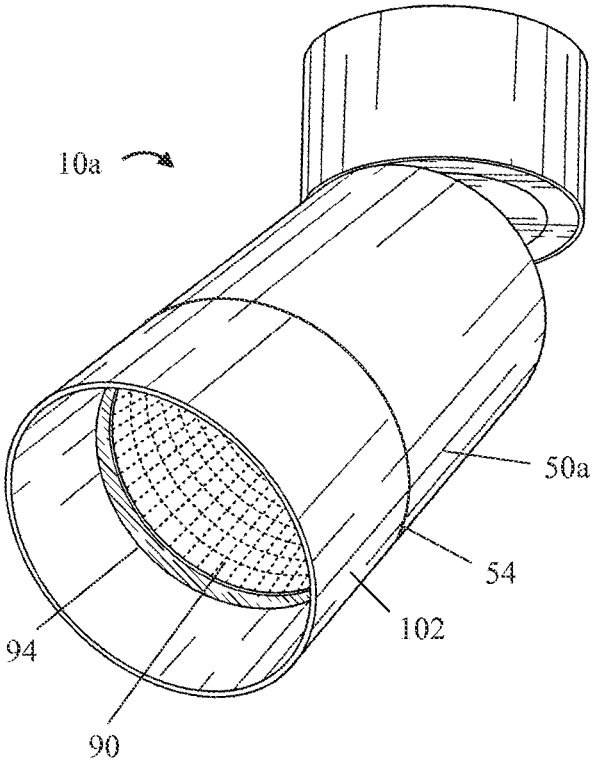
FIG. 3 is a perspective view of a second embodiment of the present light fixtures having a removable reflector housing.

In the embodiment shown, hinge 66 is configured (e.g., through an interior channel) to receive one or more electrical wires (e.g., to hide from view any electrical wires running between emitter housing 50 and base 14). However, in other embodiments, any such electrical wires can be substantially hidden, for example, by routing the electrical wires through a gap defined between the two pivoting members of the hinge. In this embodiment, hinge 66 is coupled to mounting surface 42 such that no portion of the hinge extends beyond stationary portion 18 of base 14 in a lateral direction in either an open position (e.g., as shown in FIGS. 1A and 3) or a closed position (e.g., as shown in FIG. 2A) of the hinge. Such features provide the aesthetic utility of substantially hiding the hinge when the fixture is installed and/or when emitter housing 50 is adjusted to a selected position relative to base 14.

Figure 2B:
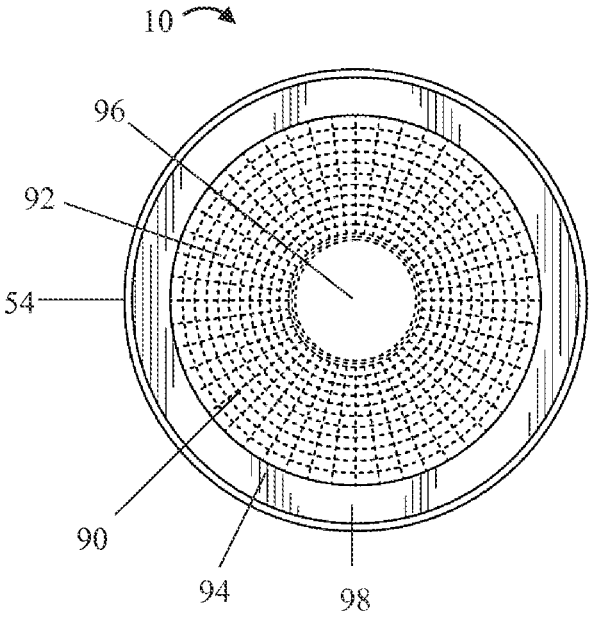
FIG. 2B is a top view of the first embodiment.

FIGS. 2A and 2B depict side and top views, respectively, of fixture 10 while emitter housing 50 is not angularly displaced relative to base 14 (e.g., as shown, emitter housing 50 is substantially aligned with base 14). In the embodiment shown, base 14 has a transverse dimension 82, emitter housing 50 has a second transverse dimension 86, and first transverse dimension 82 is substantially equal to second transverse dimension 86 (e.g., as shown). In the embodiment shown, base 14 and emitter housing 50 are both substantially cylindrical (e.g., transverse dimensions 82 and 86 can be diameters of the base and emitter housing, respectively). In other embodiments, transverse dimensions 82 and 86 can be any suitable size relative to one another (e.g., first transverse dimension 82 can be larger or smaller than second transverse dimension 86, and base 14 and/or emitter housing 50 need not be circular and/or need not be substantially cylindrical). For example, in some embodiments, emitter housing 50 and/or base 14 may comprise a generally square (or otherwise polygonal) cross-sectional shape.

In the embodiment shown, fixture 10 further comprises a reflector 90 and a lens 94 disposed in interior volume 62 of emitter housing 50 (e.g., closer to first end 54 than to second end 58). In this embodiment, reflector 90 is coupled to emitter housing 50 by way of a press and/or friction fit within interior volume 62 (e.g., such that a light source 64 disposed between the reflector and second end 58 can be replaced). In other embodiments, reflector 90 may be unitary with emitter housing 50. In the embodiment shown, reflector 90 comprises a reflective element 92 that may, for example, comprise curved portions (e.g., parabolic, elliptical, spherical, and/or otherwise concave portions) and/or linear portions (e.g., conical and/or otherwise tapered portions) surrounding a reflector aperture 96 (e.g., through which light from light source 64 can pass). Reflective element 92 can comprise any suitable finish, including, but not limited to, polished, mirrored, coated, sandblasted, and/or be otherwise optically modified, and/or can match the finish of emitter housing 50 and/or base 14.

In the embodiment shown, lens 94 is disposed between reflector 90 and first end 54 (e.g., disposed on either side of an annular recessed surface 98 which protrudes from an outside wall of emitter housing 50 and into interior volume 62, as shown, which can be a component of reflector 90, emitter housing 50, and/or removable reflector housing 102, described below). In other embodiments, reflector 90 may be disposed between lens 94 and first end 54, or reflector 90 and/or lens 94 may be omitted.

FIG. 3 depicts a second embodiment 10*a* of the present light fixtures. Fixture 10*a* is substantially similar to fixture 10 with the primary exception that fixture 10*a* comprises a removable reflector housing 102 coupled to first end 54 of emitter housing 50*a*. In the embodiment shown, reflector 90 and lens 94 form part of and/or are components of removable reflector housing 102 (e.g., as shown, and can be removed with the reflector housing, for example, simultaneously with the reflector housing). In other embodiments, reflector 90 and/or lens 94 can instead be secured between emitter housing 50*a* and removable reflector housing 102, or the reflector and/or the lens can be omitted (e.g., similar to as described above for fixture 10). Otherwise, reflector 90 and lens 94 can be oriented and/or configured in a substantially similar fashion to as described above with respect to fixture 10 (e.g., the lens can be configured to convey light from and/or to the reflector). In the embodiment shown, removable reflector housing 102 is removably secured to emitter housing 50*a* via a threaded connection (e.g., adjacent first end 54 of emitter housing 50*a*, as shown) between the emitter housing and the removable reflector housing. In other embodiments, removable reflector housing 102 can be removably secured to emitter housing 50*a* by any structure which permits the functionality described in this disclosure, including, but not limited to, adhesive, fasteners (e.g., screws, rivets, nuts, bolts, and/or the like), interlocking features disposed on removable reflector housing 102 and/or emitter housing 50*a*, a friction fit between the removable reflector housing and the emitter housing, and/or the like.

Figure 4A:
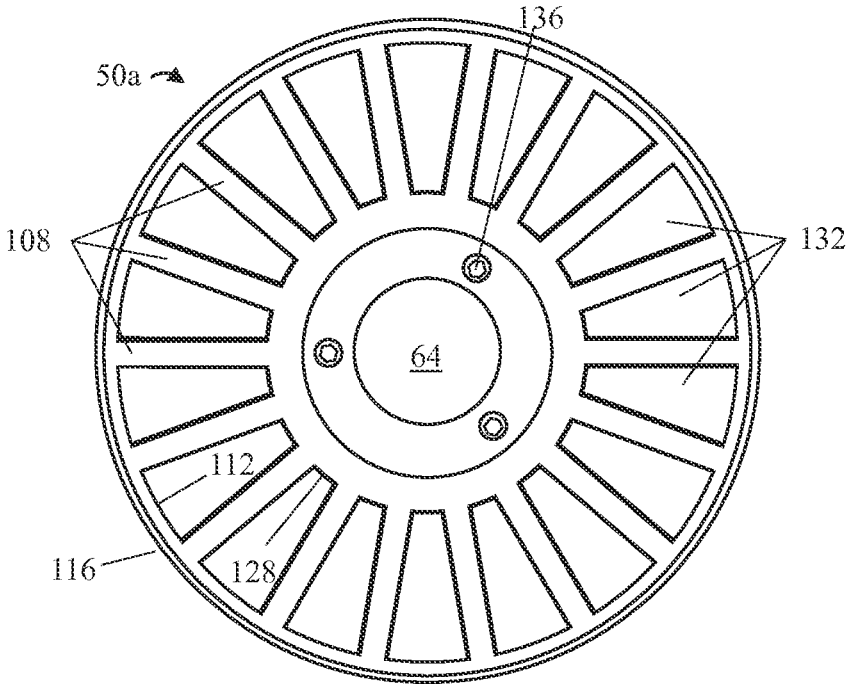
FIGS. 4A and 4B are top and cross-sectional side views, respectively, of the emitter housing of the second embodiment.
Figure 4B:
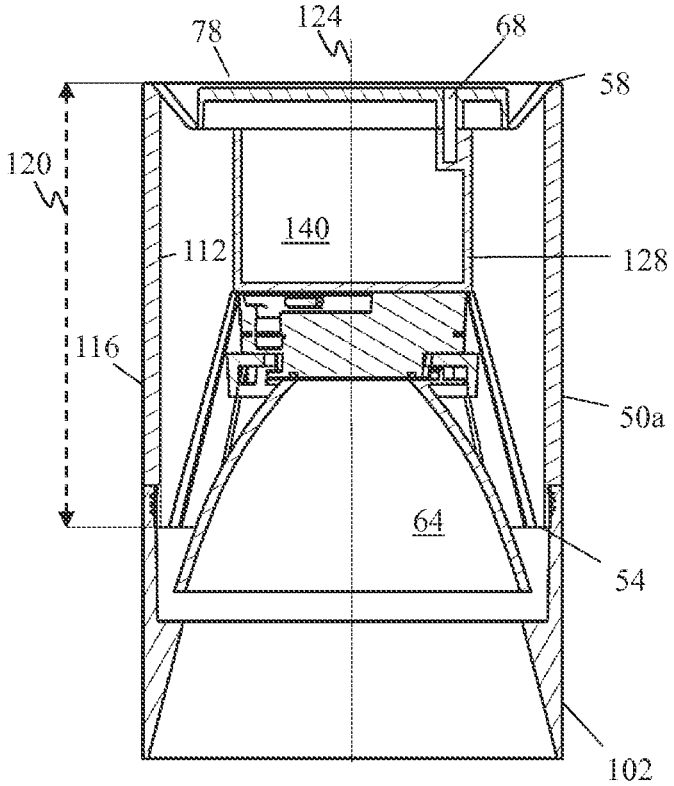

FIGS. 4A and 4B depict top and cross-sectional side views, respectively, of emitter housing 50*a* of fixture 10*a*. While the following features are discussed with respect to fixture 10*a*, such features may also be included in fixture 10 (e.g., some of which are shown in FIG. 1A). In the embodiment shown, emitter housing 50*a* further comprises a plurality of cooling fins 108 disposed on an interior surface 112 of an outer wall 116 of emitter housing 50*a* (e.g., radially disposed at substantially equiangular spaces around light source 64). As shown in FIG. 4B, light source 64 may include a primary reflector that, if present, can function as the only reflector in a fixture or in addition to reflector 90. In this embodiment, cooling fins 108 extend a distance 120 from second end 58 towards first end 54 along a longitudinal axis 124 of emitter housing 50*a*. As shown, cooling fins 108 can taper towards the ends, for example, towards first end 54 to provide room for light source 64 and/or near second end 58, for aesthetic appeal.

In the embodiment shown, emitter housing 50*a* comprises an interior wall 128 coupled to each of the plurality of cooling fins such that outer wall 116, cooling fins 108, and interior wall 128 cooperate to define a plurality of air cooling channels 132 (e.g., as shown, within the emitter housing). In this embodiment, cooling fins 108, interior surface 112, outer wall 116, and/or interior wall 128 can be unitary with emitter housing 50*a* (e.g., cast from a mold or machined from a single billet of material). While not required in all embodiments, in the embodiment shown, air cooling channels 132 extend through second end 58 of emitter housing 50*a* (e.g., such that the air cooling channels are configured to be in fluid communication with air from the environment) (e.g., as shown in FIG. 1A). In some embodiments, the present fixtures comprise a cooling fan (e.g., within interior volume 62) configured to direct air over cooling fins 108 and/or through air cooling channels 132 (e.g., to facilitate heat transfer from the cooling fins to the environment). In the embodiment shown, the plurality of cooling fins are in thermal communication (e.g., directly and/or indirectly in contact, as shown) with light source 64 such that the cooling fins are configured to conduct heat away from light source 64. In some embodiments (e.g., 10, 10*a*, and/or the like), thermal grease can be applied to the coupling interface between light source 64 and the emitter housing (e.g., to further facilitate and/or improve heat transfer away from the light source).

In the embodiment shown, light source 64 is coupled to emitter housing 50*a* with a plurality of fasteners 136. In the embodiment shown, access to fasteners 136 (e.g., to decouple and/or remove light source 64 from emitter housing 50*a*) is permitted through first end 54 of emitter housing 50*a* (e.g., as shown); however, in other embodiments access to fasteners 136 can be permitted through second end 58 of the emitter housing.

In the embodiment shown, interior wall 128 defines an interior channel 140 configured to receive light control components (e.g., LED drivers, wiring, hardware, driver circuitry, control circuitry, other components and/or the like). In the embodiment shown, housing 50*a* comprises a housing cap 78 that can be secured to second end 58 of the housing (e.g., to conceal and/or protect any light control components disposed within interior channel 140). In other embodiments, the region defined and/or bounded by interior wall 128 can be solid, and any wiring associated with light source 64 and/or other components can be routed through emitter housing 50*a*, such as, for example, through one or more air cooling channels 132. In some embodiments, light control components can be (e.g., only or additionally) disposed within base 14 (e.g., received within base 14, within rotatable portion 20, stationary portion 18, and/or a volume 144, shown in FIG. 1B, which can be defined by and/or between the rotatable portion and/or the stationary portion and/or within an electronics housing 52). In yet other embodiments, such control components may be (e.g., only or additionally) routed through and/or disposed within a structure (e.g., 34, such as within a wall, ceiling, floor, and/or junction box).

Some of the present methods for adjusting the direction of light from a light fixture (e.g., 10, 10*a*, and/or the like) having an emitter housing (e.g., 50) coupled through a hinge (e.g., 66) to a rotatable portion (e.g., 20) of a base (e.g., 14) comprise rotating (e.g., as indicated by arrow 46) the rotatable portion, where the rotatable portion is bounded by a stationary portion (e.g., 18) of the base and angularly displacing (e.g., angular displacement 70) the emitter housing relative to the rotatable portion through actuation of the hinge.

The above specification and examples provide a complete description of the structure and use of exemplary embodiments.

Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A light fixture comprising:

a base comprising:

a stationary portion having:

a sidewall defining an interior volume;

a first end defining an opening into the interior volume;

a second end configured to secure the light fixture to a structure; and at least one retaining member disposable within the interior volume;

a rotatable portion having:

a mounting surface; and a peripheral ridge;

where the rotatable portion is configured to be disposed within the opening of the stationary portion such that:

the peripheral ridge is received between the at least one retaining member and the first end of the stationary portion; and the rotatable portion is rotatable relative to the stationary portion in the plane of the first end of the stationary portion;

an emitter housing having a first end and a second end, the first end defining an aperture, and the emitter housing defining an interior volume configured to receive a light source; and a hinge coupled to the mounting surface and the second end of the emitter housing and configured to permit angular displacement of the emitter housing relative to the rotatable portion.

2. The light fixture of claim 1, where the rotatable portion is configured to be rotatably disposed within the opening such that the mounting surface is substantially flush with the first end of the base.

3. The light fixture of claim 1, where the base has a first transverse dimension, the emitter housing has a second transverse dimension, and the first transverse dimension is substantially equal to the second transverse dimension.

4. The light fixture of claim 3, where the base and the emitter housing are substantially cylindrical.

5. The light fixture of claim 1, where the emitter housing further comprises a reflector disposed proximate the first end.

6. The light fixture of claim 1, where the emitter housing further comprises a lens disposed proximate the first end.

7. The light fixture of claim 1, further comprising a removable reflector housing configured to be coupled to the first end of the emitter housing, the removable reflector housing having a reflector.

8. The light fixture of claim 1, where the emitter housing further comprises a plurality of cooling fins disposed on an interior surface of an outer wall of the emitter housing and extending a distance from the second end towards the first end along a longitudinal axis of the emitter housing.

9. The light fixture of claim 8, where the emitter housing further comprises an interior wall coupled to each of the plurality of cooling fins such that the outer wall, the cooling fins, and the interior wall cooperate to define a plurality of air cooling channels.

10. The light fixture of claim 9, where the interior wall further defines an interior channel configured to receive light control components.

11. The light fixture of claim 9, where the air cooling channels extend through the second end of the emitter housing.

12. The light fixture of claim 1, where the hinge is coupled to the mounting surface such that no portion of the hinge extends beyond the stationary portion in a lateral direction when the hinge is in either an open position or a closed position.

13. The light fixture of claim 1, where the base is configured to releasably hold a selected planar rotation of the rotatable portion relative to the stationary portion through friction.

14. The light fixture of claim 1, where the hinge is configured to releasably hold a selected angular displacement of the emitter housing relative to the rotatable portion through friction.

15. The light fixture of claim 1, where planar rotation of the rotatable portion relative to the stationary portion is limited to a maximum rotation of approximately 362 degrees.

16. The light fixture of claim 1, where angular displacement of the emitter housing relative to the rotatable portion is limited to a maximum angular displacement of approximately 45 degrees.

17. The light fixture of claim 1, where the at least one retaining member is configured to be coupled to the stationary portion such that a force applied to the rotatable portion by the at least one retaining member is adjustable.

18. The light fixture of claim 1, comprising:

one or more spacers configured to be disposed between at least one of:

the at least one retaining member and the peripheral ridge; and the peripheral ridge and the first end of the stationary portion;

where the one or more spacers are configured to facilitate positioning of the rotatable portion relative to the stationary portion.

19. A method for adjusting the position of an emitter housing of a light fixture, the emitter housing coupled through a hinge to a rotatable portion of a base having a stationary portion, the method comprising:

rotating the rotatable portion relative to the stationary portion; and angularly displacing the emitter housing relative to the rotatable portion through actuation of the hinge;

where the stationary portion includes:

a sidewall defining an interior volume;

a first end defining an opening into the interior volume;

a second end configured to secure the light fixture to a structure; and at least one retaining member disposed within the interior volume;

where the rotatable portion includes:

a mounting surface; and a peripheral ridge; and where the rotatable portion is disposed within the opening of the stationary portion such that the peripheral ridge is received between the at least one retaining member and the first end of the stationary portion.

20. The method of claim 19, where the at least one retaining member is coupled to the stationary portion such that a force applied to the rotatable portion by the at least one retaining member is adjustable.

* * * * *